US012042055B2

(12) United States Patent
Park et al.

(10) Patent No.: US 12,042,055 B2
(45) Date of Patent: Jul. 23, 2024

(54) FLAME RETARDANT NON-WOVEN FABRIC FOR MATTRESS AND MANUFATURING METHOD THEREOF

(71) Applicant: DITGreen Co., Ltd., Daejeon (KR)

(72) Inventors: Soon-yong Park, Daejeon (KR); Jae-ryong Moon, Daejeon (KR); Yong-dug Choi, Daejeon (KR); Hyo-sup Chang, Daejeon (KR); Yong-seok Park, Daejeon (KR); Woo-hyung Lee, Daejeon (KR); Bo-gyeong Cha, Daejeon (KR)

(73) Assignee: DITGREEN CO., LTD., Daejeon (KR)

( * ) Notice: Subject to any disclaimer, the term of this patent is extended or adjusted under 35 U.S.C. 154(b) by 540 days.

(21) Appl. No.: 17/344,421

(22) Filed: Jun. 10, 2021

(65) Prior Publication Data

US 2022/0361685 A1 Nov. 17, 2022

(30) Foreign Application Priority Data

May 14, 2021 (KR) ..... 10-2021-0062510

(51) Int. Cl.

| | |
|---|---|
| ***A47C 31/00*** | (2006.01) |
| ***D04H 1/06*** | (2012.01) |
| ***D04H 1/4258*** | (2012.01) |
| ***D04H 1/435*** | (2012.01) |
| ***D04H 1/4382*** | (2012.01) |
| ***D04H 1/46*** | (2012.01) |
| ***D04H 1/485*** | (2012.01) |

(52) U.S. Cl.

CPC ..... *A47C 31/001* (2013.01); *D04H 1/06* (2013.01); *D04H 1/4258* (2013.01); *D04H 1/435* (2013.01); *D04H 1/43835* (2020.05); *D04H 1/46* (2013.01); *D04H 1/485* (2013.01); *D10B 2401/04* (2013.01); *D10B 2503/00* (2013.01)

(58) Field of Classification Search

CPC ..... A47C 31/001; D04H 1/06; D04H 1/4258; D04H 1/435; D04H 1/46; D04H 1/43; D04H 1/4326; D04H 1/43835; D04H 1/485; D04H 1/55; D10B 2401/04; D10B 2503/00

See application file for complete search history.

(56) References Cited

U.S. PATENT DOCUMENTS

| | | | | |
|---|---|---|---|---|
| 2004/0060119 | A1 | 4/2004 | Murphy et al. | |
| 2005/0245164 | A1* | 11/2005 | Aneja | D04H 1/54 428/920 |
| 2006/0116043 | A1* | 6/2006 | Hope | D04H 1/4209 442/301 |

FOREIGN PATENT DOCUMENTS

| | | |
|---|---|---|
| JP | 8-158229 | 6/1996 |
| JP | 10-283 | 1/1998 |
| JP | 2014-217995 | 11/2014 |
| JP | 2015-021192 | 2/2015 |
| KR | 10-2006-0066073 | 6/2006 |
| KR | 10-2007-0091618 | 9/2007 |
| KR | 10-0756557 | 9/2007 |
| KR | 10-2012-0108629 | 10/2012 |
| KR | 10-1308982 | 9/2013 |
| KR | 10-2014-0065258 | 5/2014 |
| KR | 10-2029253 | 10/2019 |
| KR | 10-2205344 | 1/2021 |

* cited by examiner

*Primary Examiner* — Lynda Salvatore

(74) *Attorney, Agent, or Firm* — KILE PARK REED & HOUTTEMAN PLLC

(57) ABSTRACT

The present invention relates to a flame-retardant nonwoven fabric for a mattress, and a flame-retardant nonwoven fabric for mattresses comprising flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight provides enhanced flame retarding and mechanical properties.

3 Claims, No Drawings

FLAME RETARDANT NON-WOVEN FABRIC FOR MATTRESS AND MANUFATURING METHOD THEREOF

CROSS-REFERENCE TO RELATED APPLICATION

This application claims priority to and the benefit of Korean Patent Application No. 10-2021-0062510 filed in the Korean Intellectual Property Office on May 14, 2021, the entire contents of which are incorporated herein by reference.

BACKGROUND OF THE DISCLOSURE

1. Field of the Disclosure

The present invention relates to a flame-retardant nonwoven fabric composed of several fibers to be suitable for use as a bed mattresses.

2. Description of the Related Art

Mattresses are generally placed on a bed frame constituting a bed used in each home and are used for people to have a comfortable sleep and rest.

Mattresses are generally composed of a tension element having its own tension force and a cover member covered on its outer circumferential surface.

In general, the basic performance of a mattress is heat retention, ventilation, resilience, and durability that can maintain its volume even when used for a long time. In other words, the mattress should have good heat retention to maintain the user's body temperature, air ventilation inside and outside the mattress should be smooth, and the contraction and resilience by the user's load should also be good.

Mattresses are generally rectangular in shape, and are generally composed of a core material, an interior material, and a cover.

The core material has the greatest influence on the feeling of the mattress, and springs, latex, and memory foam are used as materials. The interior material performs various functions of the mattress between the core material and the cover. The cover is the area in direct contact with the body.

Since the interior material and the cover affect the human body, antibacterial, sterilizing, and deodorizing functions are pursued, so there is no inconvenience or problem during use. However, if an unexpected fire occurs during use and sparks are ignited on the mattress, interior materials and covers made of simple textile materials are easily incinerated. In addition, there is a problem that a greater fire and personal injury occur as toxic gases that are harmful to the human body are generated during incineration.

The interior material and the cover are usually manufactured by being integrated by a known quilting method in a state in which non-woven fabric, padding, and fabric are stacked in order from the inside to the outside, and the material used here is pointed out as a major factor in the spread of mattress fire.

Accordingly, various fiber materials used for mattresses are required to have flame retardancy or flame proofing.

Non-woven fabrics are used in mattresses because they have a large degree of freedom with respect to thickness, no wrinkles, and can have thermokeeping.

Korean Patent No. 0756557 discloses a flame-proof nonwoven fabric using a flame-retardant rayon yarn. According to the above patent, a nonwoven fabric composed of flame-retardant rayon yarn, modacrylic yarn, and low melting polyester yarn exhibits flame proofing, but the effect is not excellent, and thus, improvement of flame proofing is continuously required.

SUMMARY OF THE DISCLOSURE

In order to solve the above-described problems, an object of the present invention is to provide a nonwoven fabric for a mattresses having a function suitable as an interior material for bedding while having flame proofing and a method of preparing the same.

In order to solve the above problems, the present invention provides a flame-proof nonwoven fabric for mattresses comprising: flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight.

In addition, the present invention provides a method of preparing a flame-retardant nonwoven fabric for mattresses comprising: blending flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight; preparing a web by carding and laying blended fibers; needle punching the web; and heat-treating the web.

DETAILED DESCRIPTION OF THE EMBODIMENTS

The nonwoven fabric for mattresses of the present invention comprises flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight.

Rayon fiber is a fiber material that is used in various applications such as lining of outerwear or underwear, and has hygroscopicity, has excellent antistatic function to prevent static electricity, and excellent tactile feeling, which can prevent user discomfort due to static electricity.

Flame-retardant rayon fibers are fibers in which flame retardancy is imparted to rayon fibers, and can be manufactured by adding and modifying a phosphorus-based flame retardant in the spinning step of rayon. Flame-retardant rayon fiber maintains the drape, absorbency, and the sense of touch of rayon, and has an LOI of 28, which has low volume of smoke outbreak, does not generate harmful gases, has washing durability, and can be dyed.

It is preferable to use the flame-retardant rayon fiber having a fineness of 1 to 5 denier and a length of 37 to 127 mm.

If the content of flame-retardant rayon fibers in the nonwoven fabric is less than 20% by weight, static electricity is generated when blending the fibers to produce a nonwoven fabric, so that the blended fiber is not uniformly formed and the flexibility is lowered, and if it exceeds 50% by weight, the elasticity of the nonwoven fabric is deteriorated, and even if the fire is easily removed, the fire does not go out immediately, so the flame proofing decreases.

Modacrylic fibers are acrylic synthetic fibers made from a polymer containing acrylonitrile as a main component. Preferably, the polymer is a copolymer containing 30 to 60% by weight of acrylonitrile and 70 to 30% by weight of halogen-containing vinyl monomer. The halogen-containing vinyl monomer is, for example, at least one monomer selected from vinyl chloride, vinylidene chloride, vinyl bromide, vinylidene bromide, and the like. Examples of vinyl monomers capable of copolymerization include acrylic acid, methacrylic acid, salts or esters of such acids, acrylamide, methylacrylamide, vinyl acetate, and the like.

A preferred modacrylic fiber is a copolymer of acrylonitrile in combination with vinylidene chloride and such copolymer may additionally contain antimony oxide or antimony oxides for improved flame retardancy.

The LOI of modacrylic fibers is 25 to 32.

Modacrylic produces flame retardant gases during combustion as a barrier to oxygen. However, it also produces a significant amount of acid gas.

Modacrylic fiber itself is excellent in strength, elasticity, flame proofing and chemical resistance. In addition, among the fibers having flame retardancy, the price is relatively inexpensive, so it is widely used in work clothes, flame retardant lab coats, carpets, curtains, and the like. However, when exposed to sunlight, discoloration is likely to occur, the dyeing property is poor, and when dyeing, the elasticity is low, so there are restrictions on using it alone.

If the modacrylic fiber of the nonwoven fabric is less than 30% by weight, the generation of flame-retardant gas that is heavier than air that suppresses the contact of inflammable substances and oxygen decreases during combustion, so that the flame retardancy and flame proofing (flame retardation) decrease and elasticity decreases. If it exceeds 60% by weight, heat resistance is low during combustion, the length of carbonization (char) is increased, and a lot of harmful smoke is generated causing pollution and it is easy to generate a nep at the stage of mixing.

Since polyimide fibers decompose at a temperature of 450° C. or higher, they have excellent heat resistance and heat barrier properties, thermal stability, chemical resistance to acids and bases, and excellent strength.

The LOI of the polyimide fiber is 37.

In the nonwoven fabric of the present invention, the polyimide fiber improves thermal stability, heat barrier properties, and dimensional stability. Accordingly, since the nonwoven fabric of the present invention is carbonized more rapidly, flame retardancy and flame proofing are improved.

Polyimide is excellent in heat resistance, so that the carbonized film is not broken by functioning as a flexible stiffener in the carbonized film. This suppresses further combustion and reduces the length of carbonization in the nonwoven fabric.

In addition, since the carbonized film remains rigid, it prevents heat or combustion from being transferred to the inside so that further combustion does not occur.

If the polyimide fiber in the nonwoven fabric is less than 10% by weight, the thermal properties decrease and the carbonized portion increases, the combustion does not stop quickly, and the fiber is cut a lot when needle punching, so that the shape stability and mechanical properties of the nonwoven fabric are deteriorated. And if it exceeds 30% by weight, the increase in the flame proofing effect is negligible and economically undesirable.

Low melting polyester (LM PET) fibers have a melting point of 150 to 200° C., and are melted in the above temperature range to exhibit a function of fusion bonding.

When heat is applied after needle punching when manufacturing the nonwoven fabric, the low-melting polyester fiber serves as an adhesive by fusion bonding. This improves the mechanical strength and durability of the nonwoven fabric.

In addition, a carbonized film is formed in the nonwoven fabric by a substance that is first melted and thermally decomposed during combustion. Since this carbonized film suppresses the shrinkage of the nonwoven fabric to form a film that fills the voids of the nonwoven fabric, flame retardancy and flame proofing are improved in the nonwoven fabric.

If the low melting polyester fiber is less than 5% by weight in the nonwoven fabric, the mechanical strength and durability of the nonwoven fabric decreases, and if it exceeds 20% by weight, the nonwoven fabric becomes hard due to heat fusion, and shrinkage occurs due to heat, resulting in a rapid deterioration in flame retardancy and flame proofing.

At this time, if the melting point of the low melting polyester fiber is less than 150° C., the properties of the low melting polyester fiber may be deteriorated and detached by the following moist heat treatment.

It may be preferable to use the low melting polyester fiber coated with graphene.

The graphene-coated low melting polyester fiber facilitates blending the fibers by suppressing the generation of static electricity when blending the fibers, and in the heat treatment step of the present invention, when passing through the calender roll, heat transfer is promoted to provide a uniform thermal adhesion and an outer surface, and an antibacterial nonwoven fabric may be provided.

The non-woven fabric of the present invention has improved flame proofing and mechanical properties even without a separate flame retardant treatment.

A method of preparing a flame-retardant nonwoven fabric for mattresses of present invention comprises blending flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight; preparing a web by carding and laying blended fibers; needle punching the web; and heat-treating the web.

The fineness of each of the staple fibers is 1 to 5d (denier) and the length is 37 to 127 mm, and it is easy to blend, and a high-density nonwoven fabric is manufactured and it is possible to provide a nonwoven fabric with flexibility and elasticity and improved tensile strength.

If the fineness of each staple fiber is less than 1d, the fiber is easily cut during needle punching, resulting in a decrease in the mechanical strength of the nonwoven fabric, and if it exceeds 5d, it is difficult to improve the binding force between fibers by needle punching, and the elasticity of the nonwoven fabric decreases, and it is difficult to obtain a high-density nonwoven fabric.

If the length of each of the staple fibers is less than 37 mm, the mechanical strength decreases, and if it exceeds 127 mm, the mechanical strength increases, but the blending is not uniformly performed and the blending workability deteriorates.

Polyimide staple fibers have a smooth surface, low modulus, and high elongation, and thus are not easily mixed with other fibers.

In the present invention, in order to exhibit the inherent mechanical properties of the polyimide staple fibers in the nonwoven, it is preferable that the number of crimp of the polyimide staple fibers is 3 to 12 times/inch, and if the number of crimp is less than 3 times/inch, the elasticity of the nonwoven fabric decreases, and if it exceeds 12 times/inch, it is difficult to produce a uniform web when carding.

In the process of processing polyimide fibers, friction occurs in machinery, etc. and it is easy to fibrillate due to such friction, and thus the fiber is easily detached during the processing.

In addition, since it is a synthetic fiber, static electricity is easily generated, so that workability is deteriorated when blending and carding, and when needle punching is performed, there is a problem that the workability is deteriorated, such as damage to the needle.

In the present invention, it is possible to use polyimide staple fibers subjected to oil agent treatment to solve this problem.

The polyimide staple fibers treated with the oil agent are staple fibers having an oil agent adhesion amount of 0.5 to 1.0% by weight based on the weight of the fibers.

By using the oil agent-treated polyimide staple fibers, a uniform web can be formed by suppressing the generation of static electricity when blending and carding, and the fibers are cut by a needle during needle punching and thus it is possible to suppress a decrease in the strength of the nonwoven fabric.

The oil agent is preferable to comprise (A) 20 to 60% by weight of fatty acid ester having a molecular weight of 200 to 500, (B) 0.5 to 5% by weight of dimethyl silicone, (C) 5 to 30% by weight of a quaternary ammonium salt type or amine type cationic activator, and (D) 15 to 50% by weight of a nonionic activator.

The oil agent has improved smoothness by mixing a small amount of the component (B) with the component (A), which is the main component, and the antistatic property is expressed by the component (C), and it is possible to have an emulsion form by the component (D).

The component (A) imparts smoothness to staple fibers and can suppress breakage of the needle when needle punching is performed.

When the molecular weight of the component (A) is less than 200, the viscosity is low and it is easy to volatilize, and when the molecular weight of the component (A) exceeds 500, the viscosity increases and it is difficult to provide smoothness.

If the content of the component (A) in the oil agent is less than 20% by weight, it is difficult to provide smoothness, and if it exceeds 60% by weight, the emulsification is not uniform and it difficult to provide an emulsion to the fibers.

Examples of the component (A) include methyl palmitate, methyl stearate, methyl oleate, butyl laurate, lauryl laurate, and the like.

If the content of the component (B) in the oil agent is less than 0.5% by weight, the effect of improving smoothness is insignificant, and if it exceeds 5% by weight, the emulsification may not be uniform.

When the oil agent contains a small amount of the component (B), the smoothness is further improved and the content ratio of the component (A) can be lowered. Accordingly, by increasing the content of other components, it is possible to suppress the generation of static electricity during carding and improve the stability of the emulsion of the oil agent.

If the content of the component (C) in the oil agent is less than 5% by weight, the antistatic effect is small, and if it exceeds 30% by weight, the viscosity increases and smoothness may decrease.

Examples of the component (C) include lauryl trimethyl ammonium chloride, lauryl dimethyl ethyl ammonium chloride, and lauryl dimethyl ethyl ammonium bromide.

If the component (D) in the oil agent is less than 15% by weight, it is difficult to prepare the oil agent as an aqueous emulsion, and if it exceeds 50% by weight, the smoothness decreases and fluff or single yarn may occur due to friction with the guide, which deteriorates the quality of the fiber.

Examples of the component (D) include an ethylene oxide adduct of a higher alcohol, an ethylene oxide adduct of an alkyl phenol, an ethylene oxide adduct of a fatty acid, an ethylene oxide adduct of a fat or oil, and a fatty acid ester of a polyhydric alcohol. For example, ethylene oxide adduct of lauryl alcohol and oleyl alcohol, nonyl phenol and benzyl phenyl phenol, ethylene oxide adduct of tristyrene phenol, ethylene oxide adduct of lauric acid and stearic acid, ethylene oxide adduct of castor oil and hydrogenated castor oil, ethylene oxide adduct of glycerin and sorbitan and lauric acid esters, and the like.

The staple fibers treated by the oil agent have high smoothness and thus can be suppressed from being wound around a cylinder or a roller during a manufacturing process. This improves the passability when carding and it is possible to prepare a web with no uneven thickness.

In addition, since the coefficient of dynamic friction of the web can be reduced, the needle punching processability is excellent, so that the cutting of the needle is small, the entanglement of the fibers is increased to obtain a nonwoven fabric having an increased density. In addition, staple fibers with less generation of static electricity and excellent processability are provided during the process.

Each of the flame-retardant rayon staple fibers, modacrylic staple fibers, and low melting polyester staple fibers of the present invention may be treated with the above oil agent.

The needle punching may be performed using a conventional method without limitation.

During the needle punching, a nonwoven fabric having a thickness of 3 to 7 mm and a basis weight of 100 to 1000 $g/m^2$ is formed by punching with a stroke of 200 to 650 $times/m^2$ with a barb-type needle with a needle length of 70 to 120 mm.

After the step of needle punching, heat treatment was performed to improve the binding strength of the fibers constituting the nonwoven fabric by using a low melting polyester.

The heat treatment of the present invention imparts smoothness to the nonwoven fabric and causes heat bonding between the fibers constituting the nonwoven fabric by passing the nonwoven fabric while pressing it in a calender roll device. Due to this, the shape of the final product, the nonwoven fabric, can be stably maintained.

The heat bonding temperature is set higher than the melting temperature of the low melting polyester fiber so that the low melting polyester fiber is melted and bonded to the flame-retardant fiber.

In the heat treatment, it is preferable to repeatedly pass the needle-punched web through the calender roll at least three times or more. At this time, it is more preferable to sequentially increase the temperature of the calender roll to heat-bond 10 to 20° C. (first calender roll), 20 to 30° C. (second calender roll) and 30 to 40° C. (third calender roll) higher than the melting temperature of the low melting polyester fiber.

In the present invention, by further performing the step of deoiling after the step of needle punching and before the step of heat treatment, the adhesion amount of the oil agent in the nonwoven fabric can be adjusted to 0.3% or less based on the weight of the fibers constituting the nonwoven fabric.

If it exceeds 0.3%, the frictional force between the fibers decreases, and the mechanical properties may deteriorate. That is, since the adhesion amount of the oil agent is lowered by the deoiling, the frictional force between the fibers is increased, so that the mechanical properties of the nonwoven fabric are further improved.

The method of deoiling can be used without limitation, such as washing, hot water washing, and high-temperature calendering treatment, but it is more preferable to perform moist heat treatment at 130 to 145° C. for 10 to 90 minutes in a high humidity atmosphere.

At this time, the moist heat treatment may be performed using high-pressure steam in an autoclave or in a high-pressure dyeing machine.

Due to the moist heat treatment, since the flame-retardant rayon staple fibers and modacrylic staple fibers constituting the nonwoven fabric are expanded and softened by moisture and are plasticized, when the nonwoven fabric passes through the calender device in the heat treatment step, wrinkles generated due to differences in properties of each fiber constituting the nonwoven fabric can be suppressed.

The nonwoven fabric of the present invention exhibits mechanical strength and durability while being lightweight with a basis weight of 200 to 1,000 g/m$^2$.

The nonwoven fabric for mattresses of the present invention manufactured by the above-described method improves flame retardancy and flame proofing because the generation of toxic gases and the carbonization length are reduced by the polyimide fiber. In addition, since the bonding strength between the fibers constituting the nonwoven fabric is increased by the low melting polyester fiber, the mechanical strength and durability of the nonwoven fabric are improved.

On the other hand, since the processability is improved in the fiber processing process of nonwoven fabric manufacturing by the polyimide staple fibers with the number of crimp of 3 to 12 times/inch, the properties as a fiber product are improved.

Hereinafter, the present invention will be described in more detail based on the following Examples and Comparative Examples.

Hereinafter, the present invention will be described in more detail through examples. These examples are only intended to illustrate the present invention in more detail, and it will be apparent to those skilled in the art that the scope of the present invention is not limited by these examples according to the gist of the present invention. The examples of the present invention are provided to more completely explain the present invention to those of ordinary skill in the art.

Example 1

Flame-retardant rayon staple fibers (1d×51 mm) of 32% by weight, modacrylic staple fibers (2d×51 mm) of 45% by weight, polyimide staple fibers (1d×51 mm, number of crimps 8 times/inch) of 15% by weight and LM PET staple fibers having melting point of 150° C. (2d×51 mm) of 8% by weight were mixed in the blending process. Thereafter, carding was performed in a roller card machine at a speed of 30 m/min to prepare a sheet-like web, and laid in several layers in a cross-lay device. Then, in the needle punching process, the fibers were entangled by punching at 500 strokes/m$^2$ using a needle board to which 20,000 barb-type needles with a needle length of 100 mm attached.

Thereafter, a flame-retardant nonwoven fabric of 500 g/m$^2$ was prepared by heat treatment sequentially passing the first to third calender rolls of 160° C., 170° C. and 180° C. using a calender roll device.

Example 2

A flame-retardant nonwoven fabric was prepared in the same manner as in Example 1, except that flame-retardant rayon staple fibers (1d×51 mm) of 28% by weight, modacrylic staple fibers (2d×51 mm) of 35% by weight, polyimide staple fibers (1d×51 mm, number of crimps 8 times/inch) of 25% by weight and LM PET staple fibers having melting point of 150° C. (2d×51 mm) of 12% by weight were used as raw materials.

Example 3

A flame-retardant nonwoven fabric was prepared in the same manner as in Example 1, except that oil agent consisting of methyl stearate of 40% by weight, dimethyl silicone having viscosity of 10 mm$^2$/s of 3% by weight, lauryltrimethylammonium chloride of 25% by weight, and 5 mole adduct of ethylene oxide of lauryl ether of 32% by weight was attached to 0.8% of the total weight of the fibers.

Example 4

A flame-retardant nonwoven fabric was prepared in the same manner as in Example 3, except that after the needle punching process, before heat treatment, it was subjected to moist heat treatment at 140° C. for 30 minutes so that the oil agent was adhered to 0.25% of the weight of the fibers constituting the nonwoven fabric.

Comparative Example 1

A flame-retardant nonwoven fabric was prepared in the same manner as in Example 1, except that flame-retardant rayon staple fibers (1d×51 mm) of 40% by weight, modacrylic staple fibers (2d×51 mm) of 47% by weight, polyimide staple fibers (1d×51 mm, number of crimps 8 times/inch) of 5% by weight and LM PET staple fibers having a melting point of 150° C. (2d×51 mm) of 8% by weight were used as raw materials.

Comparative Example 2

A flame-retardant nonwoven fabric was prepared in the same manner as in Example 1, except that flame-retardant rayon staple fibers (1d×51 mm) of 20% by weight, modacrylic staple fibers (2d×51 mm) 35% by weight, polyimide staple fibers (1d×51 mm, number of crimps 8 times/inch) of 20% by weight and LM PET staple fibers having a melting point of 150° C. (2d×51 mm) 25% by weight were used as raw materials.

The nonwoven fabric according to the Examples and Comparative Examples and the workability for manufacturing the same were evaluated as follows, and were shown in Tables 1 to 3.

<Evaluation method>

1. Flame Proofing

It is measured by KOFEIS 1001, a Korean flame retardant performance standard.

2. Carding Equipment Passability

It is evaluated by observing the state where the fibers are wound around the cylinder and the uniformity of the resulting web during carding.

If the web was very poor and needle punching could not be performed smoothly, it was judged as x, in the case of performing smoothly, it was judged as °, and the middle one as Δ

3. Generation of Static Electricity in Carding Equipment

The amount of static electricity (kV) was measured with a static electricity meter at a distance of 10 cm from the web between the Doffer and the take-up roller under the conditions of 25° C. and 45% RH.

4. Needle Punching Property

When needle punching is performed, the number of damaged needles on the needle board is measured in units per hour to evaluate needle punching properties.

5. Tensile Strength

It is measured in accordance with the Korean Industrial Standard KS G 4300: 2020.

TABLE 1

| | KOFEIS 1001 basis | Example 1 | Example 2 | Example 3 | Example 4 | Comparative Example 1 | Comparative Example 2 |
|---|---|---|---|---|---|---|---|
| Afterflame time (sec) | Within 5 sec | 2 | 1 | 2 | 2 | 4 | 6 |
| Afterglow time (sec) | Within 20 sec | 2 | 2 | 3 | 3 | 8 | 18 |
| Carbonized area ($cm^2$) | Within 40 $cm^2$ | 18.3 | 13.7 | 20.5 | 19.1 | 42.9 | 45.8 |
| Char length (cm) | Within 20 cm | 12.3 | 10.4 | 13.8 | 12.9 | 22.3 | 18.6 |

From the results of the flame retardancy test in Table 1, it is confirmed that the flame proofing is improved when polyimide fibers and low melting polyester fibers are added to the flame retardant fibers. In addition, it is also confirmed that when the polyimide fiber is added in an excessive amount, the flame proofing is rather lowered.

TABLE 2

| | Example 1 | Example 2 | Example 3 | Example 4 | Comparative Example 1 | Comparative Example 2 |
|---|---|---|---|---|---|---|
| Carding equipment possibility | Δ | Δ | ○ | ○ | Δ | Δ |
| Card machine static electricity generation (kV) | 2.3 | 2.5 | 0.5 | 0.5 | 1.5 | 2.9 |
| Needle punching property (units) | 46 | 58 | 9 | 9 | 35 | 62 |

From the results of Examples 3 and 4 in Table 2, it is confirmed that carding is easy when the fiber treated with the oil agent of the present invention is used, and that the needle is less damaged when needle punching is performed.

On the other hand, it was observed that when staple fibers without treatment with oil agents were used, the carding equipment possibility deteriorated and the phenomenon of sticking to the roll occurred, resulting in the formation of a non-uniform web.

TABLE 3

| | Example 1 | Example 2 | Example 3 | Example 4 | Comparative Example 1 | Comparative Example 2 |
|---|---|---|---|---|---|---|
| Longitudinal direction (N/50 mm) | 111.5 | 116.2 | 115.2 | 118.3 | 101.3 | 112.5 |
| Width direction (N/50 mm) | 70.4 | 74.5 | 72.9 | 75.3 | 65.6 | 71.2 |

From the results of the tensile strength measurement in Table 3, it was confirmed that when needle punching is performed using the staple fibers treated with oil agents, the damage to the staple fibers is reduced and the degree of entanglement is improved, thereby increasing the tensile strength.

In addition, from the results of Example 4, it was confirmed that deoiling increased the tensile strength of the nonwoven fabric because the adhesion amount of the oil agent decreased, thereby increasing the frictional force between fibers.

On the other hand, in Example 4, the occurrence of wrinkles on the outer surface of the nonwoven fabric was significantly suppressed and a nonwoven fabric having a uniform surface was prepared. From this, it was confirmed that it is due to the fact that each fiber constituting the nonwoven fabric is plasticized by the previous moist heat treatment when passing through the calender device.

In addition, it is confirmed that the nonwoven fabric of the present invention is composed of fine denier fibers, so that strength is exhibited while improving the density of the nonwoven fabric.

According to the present invention, a nonwoven fabric obtained by adding a polyimide fiber and a low melting polyester fiber to a flame retardant fiber can improve both flame proofing and mechanical properties.

What is claimed is:

1. A method of preparing a flame-retardant nonwoven fabric for mattresses comprising:

blending flame-retardant rayon (FR-Rayon) staple fibers of 20 to 50% by weight; modacrylic staple fibers of 30 to 60% by weight; polyimide (PI) staple fibers of 10 to 30% by weight; and low melting polyester (LM PET) staple fibers of 5 to 20% by weight, wherein the FR-Rayon staple fibers, the modacrylic staple fibers, the PI staple fibers, and the LM PET staple fibers are treated with an oil agent;

preparing a web by carding and laying blended fibers;

needle punching the web;

deoiling the blended staple fibers in the web; and heat-treating the web.

2. The method of preparing a flame-retardant nonwoven fabric for mattresses of claim 1, wherein the oil agent comprises 20 to 60% by weight of methyl stearate, 0.5 to 5% by weight of dimethyl silicone, 5 to 30% by weight of lauryltrimethylammonium chloride and 15 to 50% by weight of 5 mole adduct of ethylene oxide of lauryl ether.

3. The method of preparing a flame-retardant nonwoven fabric for mattresses of claim 1, wherein after the deoiling step, adhesion amount of the oil agent is 0.3% or less based on weight of fibers constituting the nonwoven fabric.

* * * * *